US008516633B2

(12) United States Patent
Dobin

(10) Patent No.: US 8,516,633 B2
(45) Date of Patent: Aug. 27, 2013

(54) MATTRESS ENCASEMENT WITH IMPROVED BED BUG PROTECTION

(75) Inventor: J. Michael Dobin, Pompano Beach, FL (US)

(73) Assignee: Valley Forge Fabrics, Inc., Pompano Beach, FL (US)

( * ) Notice: Subject to any disclaimer, the term of this patent is extended or adjusted under 35 U.S.C. 154(b) by 0 days.

(21) Appl. No.: 13/444,236

(22) Filed: Apr. 11, 2012

(65) Prior Publication Data

US 2012/0260426 A1 Oct. 18, 2012

Related U.S. Application Data

(60) Provisional application No. 61/474,584, filed on Apr. 12, 2011.

(51) Int. Cl.

| | |
|---|---|
| ***A47C 31/00*** | (2006.01) |
| ***A47C 17/00*** | (2006.01) |
| ***A44B 1/04*** | (2006.01) |
| ***A44B 17/00*** | (2006.01) |

(52) U.S. Cl.
USPC ..... 5/499; 5/699; 5/737; 5/739; 5/939; 24/387; 24/436

(58) Field of Classification Search
USPC ..... 5/499, 699, 738, 484, 737, 939; 24/387, 24/388, 436
See application file for complete search history.

(56) References Cited

U.S. PATENT DOCUMENTS

| | | | | |
|---|---|---|---|---|
| 3,601,826 | A * | 8/1971 | Smith | 5/499 |
| 4,164,797 | A * | 8/1979 | Golembeck | 5/738 |
| 4,397,378 | A * | 8/1983 | Lee | 190/119 |
| 5,666,680 | A * | 9/1997 | Hackett, Jr. | 5/692 |
| 7,552,489 | B2 | 6/2009 | Bell et al. | |
| 7,849,543 | B2 * | 12/2010 | Poston et al. | 5/699 |
| 8,087,111 | B2 * | 1/2012 | Paris | 5/499 |
| 8,156,588 | B2 * | 4/2012 | Svoboda | 5/699 |
| 8,307,480 | B2 * | 11/2012 | Tirpan | 5/699 |
| 8,413,276 | B2 * | 4/2013 | Rattner et al. | 5/699 |
| 2008/0305134 | A1 * | 12/2008 | Lucas | 424/403 |
| 2009/0271926 | A1 * | 11/2009 | Bell et al. | 5/499 |
| 2009/0293195 | A1 * | 12/2009 | McGrath et al. | 5/484 |
| 2010/0269312 | A1 | 10/2010 | Wagner et al. | |
| 2010/0281614 | A1 | 11/2010 | Park | |
| 2011/0099714 | A1 | 5/2011 | Svoboda | |
| 2011/0113553 | A1 | 5/2011 | Johan et al. | |
| 2012/0102646 | A1 * | 5/2012 | Chen et al. | 5/499 |
| 2012/0167307 | A1 * | 7/2012 | Michael | 5/501 |
| 2012/0246890 | A1 * | 10/2012 | Hernandez | 24/436 |

* cited by examiner

*Primary Examiner* — William Kelleher

*Assistant Examiner* — Eric Kurilla

(74) *Attorney, Agent, or Firm* — Laurence A. Greenberg; Werner H. Stemer; Ralph E. Locher

(57) ABSTRACT

A mattress encasement with improved bed bug protection includes an encasement body configured to cover a mattress and a zipper disposed at an opening in the encasement body and movable between an open condition permitting insertion and removal of the mattress and a closed condition preventing bed bugs from traversing the zipper. The zipper has a zipper head and a zipper pull pivotable on the zipper head. A clasp is at least partly fixed to the encasement body. A hook-and-loop fastener is associated with the encasement body and the clasp for locking the zipper pull to the clasp with the zipper in the closed condition to prevent movement of the zipper head and opening of the zipper.

14 Claims, 1 Drawing Sheet

MATTRESS ENCASEMENT WITH IMPROVED BED BUG PROTECTION

CROSS-REFERENCE TO RELATED APPLICATION

This application claims the priority, under 35 USC §119 (e), of copending Provisional Patent Application No. 61/474,584, filed Apr. 12, 2011, which is incorporated herein by reference in its entirety.

BACKGROUND OF THE INVENTION

1. Field of the Invention

The invention relates to a mattress or boxspring encasement and, more specifically, to an encasement closure that prevents bed bugs from traversing the seam, by entering into the mattress or crawling out of the mattress.

2. Description of the Related Art

The hospitality business, in particular, has recently become urgently aware of, and has been pursuing protection solutions for, bed bug infestations. Bed bugs have become a major issue since the banning of the chemical DDT. In the past four years, bed bugs have made a major resurgence and specifically in the past eighteen months, there have been store, hotel, and business closings due to bed bugs.

Bed bugs choose to remain in dark places and are attracted to humans as they feed on human blood. Although a bed bug can choose to hide in any dark part of a room, the bed is a prime target due to the amount of dark spaces and the proximity to their prey.

Bed bugs can infest a room, and it is a very difficult process to find the bugs and eliminate them from the room. The most difficult location from which to eliminate bugs is from inside a mattress or boxspring. Once inside a mattress or boxspring, the bed bugs will nest and multiply, and the mattress and/or boxspring will need to be discarded by the user since it is not possible to get pesticides or treatments within every corner of the mattress or boxspring.

The basic premise of an encasement is to protect the investment in a mattress or boxspring. If a mattress or boxspring is fully encased, there is no possibility of permeation into the product by bed bugs. Even with an infested room, the mattress and boxspring (which can cost over $1,000.00) will be protected from the infestation and the investment in those products will be saved.

Encasements are a good concept, but can only succeed with proper installation and implementation. Due to human intervention, such as housekeeping, guests and common users being required to zipper the encasement closed, there is a good possibility of the encasement not performing its required function. Normal encasements zip closed with a basic zipper ending. If the zipper is left open, even open by 1 centimeter, it is possible that bed bugs could enter the opening, nest and infest the mattress.

U.S. Pat. No. 7,552,489 B2 describes one possible device for overcoming the problem. There, a foam pad is stitched into the enclosure below the zipper. When the zipper is closed, i.e., when the zipper slide or head is located at or near the end, the zipper slide or head rides on the foam pad in order to more securely close off the opening that may remain at the end of the zipper.

U.S. patent application Publication No. US 2010/0281614 discloses an encasement opening which is extended so as to be able to fold over a zipper, creating a barrier. Velcro® is added to the extension part to seal and hold the extension part. The extension covers the zipper opening and is intended to prevent it from sliding. However, there is no mechanism for ensuring that the zipper itself is completely closed or for preventing it from opening a slight amount which would allow bed bugs to enter or leave.

U.S. patent application Publication No. US 2011/0099714 discloses an encasement having a flap secured to a lower side wall portion of a side of the encasement which is positioned inwardly of the zipper for retarding or preventing escapement of bed bugs through the zipper. Once again, there is no mechanism for ensuring that the zipper itself is completely closed or for preventing it from opening a slight amount which would allow bed bugs to enter or leave.

U.S. patent application Publication No. US 2011/0113553 shows a bed bug-resistant cover for a mattress, which has a zipper assembly that is cooperable with panels of fabric material and filter, which is welded by radio frequency welding at an inside surface of the panels of fabric material to cover a vent. That device also has no mechanism for ensuring that the zipper itself is completely closed or for preventing it from opening a slight amount which would allow bed bugs to enter or leave.

U.S. patent application Publication No. US 2010/0269312 teaches a slider assembly having interlocking parts, a slider for engaging and disengaging the interlocking parts and a cohesive zipper assembly for fastening the slider assembly to a predetermined article which has cooperating cohesive parts. Nothing in that device keeps a zipper closed or prevents a zipper from opening a slight amount which would allow bed bugs to enter or leave.

Finally, the Protect-A-Bed® AllerZip® Bed Bug Protection Kit ties a zipper pull by attaching a zip tie to a mattress encasement, looping the zip tie through a hole in a zipper pull and fastening the zip tie to prevent tampering. However, the zip tie is flexible and will allow the zipper head or slide to move along the zipper to a great enough extent to allow bed bugs to enter or leave, especially when the encasement is shifted due to use.

BRIEF SUMMARY OF THE INVENTION

It is accordingly an object of the invention to provide a mattress encasement with improved bed bug protection, which overcomes the hereinafore-mentioned disadvantages of the heretofore-known devices of this general type and which has a safety lock for the zipper closure that avoids the risk of bugs entering or escaping through a partially closed zipper.

With the foregoing and other objects in view there is provided, in accordance with the invention, a mattress encasement with improved bed bug protection. The mattress encasement comprises an encasement body configured to cover a mattress and a zipper disposed at an opening in the encasement body and movable between an open condition permitting insertion and removal of the mattress and a closed condition preventing bed bugs from traversing the zipper. The zipper has a zipper head and a zipper pull pivotable on the zipper head. A clasp is at least partly fixed to the encasement body. A hook-and-loop fastener is associated with the encasement body and the clasp for locking the zipper pull to the clasp with the zipper in the closed condition to prevent movement of the zipper head and opening of the zipper. In this way, there is absolutely no possibility of movement of the zipper head and therefore bed bugs cannot traverse the zipper, for which they need only 1 centimeter to do so.

In accordance with another feature of the invention, the hook-and-loop fastener has a material with hooks and a material with loops. The material with hooks is associated with one of the encasement body or the clasp and the material with loops is associated with the other of the encasement body or the clasp. The material with the hooks and the material with the loops may each be attached to or may form one piece with a respective one of the encasement body or the clasp.

In accordance with a further feature of the invention, the clasp has a fixed portion attached to the encasement body and a movable portion hinged to the fixed portion for sandwiching the zipper pull between the fixed and movable portions of the clasp in the closed condition of the zipper.

In accordance with a concomitant feature of the invention, the encasement body is formed of 100% Lyocell, 100% cotton, 100% polyester or a blend of at least two of those fibers.

The closure of the invention is the first closure of its kind for an encasement or general bedding product.

A mechanism is required to hold the zipper closed and in place after a guest, housekeeper, or consumer zips their encasement around their mattress. If there is no mechanism, the zipper can easily slip open with slight movements of the mattress, and even a small opening will allow bugs to penetrate through the encasement and create a nesting area in the mattress or box spring.

Bed bugs can enter normal encasements due to the fact that, with movement over time, the zippers on encasements can open slightly. The locking closure of the invention prevents such entry by allowing no movement of the zipper, i.e. by locking the zipper slide or head in place.

Other features which are considered as characteristic for the invention are set forth in the appended claims.

Although the invention is illustrated and described herein as embodied in a mattress encasement with improved bed bug protection, it is nevertheless not intended to be limited to the details shown, since various modifications and structural changes may be made therein without departing from the spirit of the invention and within the scope and range of equivalents of the claims.

The construction and method of manufacture of the invention, however, together with additional objects and advantages thereof will be best understood from the following description of specific embodiments when read in connection with the accompanying drawings.

DETAILED DESCRIPTION OF THE INVENTION

Figure 1:
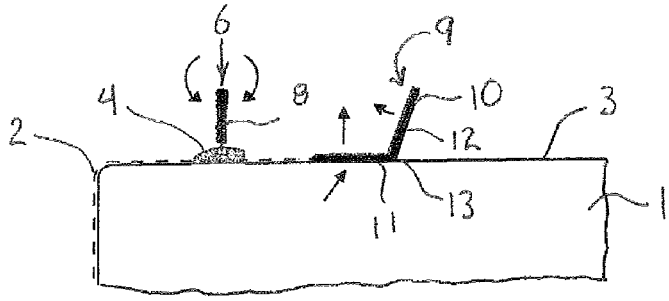
FIG. 1 is a fragmentary, diagrammatic, side-elevational view of a portion of a mattress having the mattress encasement with improved bed bug protection according to the invention.

Referring now to the figures of the drawing in detail and first, particularly, to FIG. 1 thereof, there is seen a portion of a mattress encasement 1 having a zipper 2 shown in broken lines, which is used to close an opening provided in an encasement body 3 for slipping the encasement 1 on and off a mattress. The zipper 2 has a head or slide 4 on which a zipper pull 6 pivots in the direction of curved arrows shown in FIG. 1 in a conventional manner. The zipper 2 can thus move between an open and a closed condition.

A safety lock for the zipper closure includes a material or fabric 8 which has loops and which covers the pull 6 on both sides. The material or fabric 8, such as a mesh, is wrapped around the zipper pull 6 and sewn onto the zipper pull 6. In addition, or in the alternative, the material or fabric 8 may also be glued onto the zipper pull 6 or the zipper pull 6 itself may be formed integrally or in one-piece of the material or fabric 8. In a preferred embodiment, the zipper pull is completely covered by the material or fabric 8, and the sewing keeps the material or fabric 8 from sliding or moving on the zipper. The material or fabric 8 is fastened to the zipper pull in such a way as to basically become part of the zipper pull 6.

A clasp 9 has a fixed portion 11 sewn, glued or otherwise attached to the encasement 1 and a movable portion or flap 12 hinged to the fixed portion 11 at a live or living hinge 13. The clasp 9 is covered with or formed of a material or fabric 10, such as a mesh, having hooks in a similar manner to the way in which the zipper pull 6 is covered with or formed of the material or fabric 8. Only approximately one-half of the clasp or strip 9 having the material or fabric 10 is attached to the encasement 1 in order to permit the clasp 9 to close onto itself. However, the movable portion 12 may also be omitted, leaving only the fixed portion 11.

The material 8 and the material 10 together form a hook-and-loop fastener such as Velcro®. It is understood that the material or fabric 10 may have the loops and the material or fabric 18 may have the hooks instead.

Figure 2:
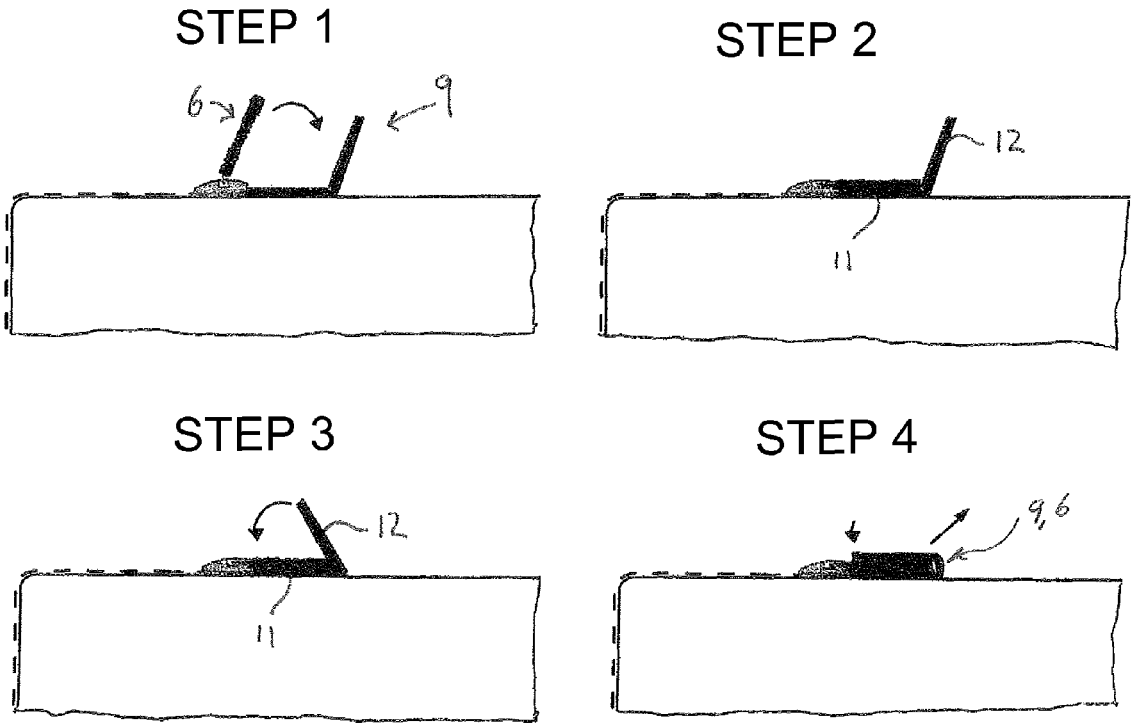
FIG. 2 includes four fragmentary, side-elevational views of the portion of the mattress shown in FIG. 1, illustrating steps carried out in the operation of the invention.

A four-step sequence of closing the encasement with the novel closure is illustrated in FIG. 2 and described below.

According to Step 1, the slide 4 is pulled by the zipper pull 6 until the zipper 2 is completely closed and the slide abuts against the clasp 9 and can be pivoted as shown by the arrow. According to Step 2, the zipper pull 6 is placed or pressed against the fixed portion 11 of the clasp 9. According to Step 3, the movable portion 12 of the clasp 9 having the material or fabric 10 is folded over the zipper pull 6 having the material or fabric 8 as shown by the arrow. As is seen in Step 4, a so-called hook-and-loop fastener sandwich is formed by the materials or fabrics 8 and 10 in which the zipper pull 6 is locked in place at the clasp 9 with the zipper closed.

The encasement 1, like the mattress itself, is six-sided, and is closed with an L shaped zipper. An L-shaped zipper includes a zipper on the bottom and on one side of the product, so that it is two-sided.

The fabric of the encasement 1 is 100% Lyocell, but can also be made with 100% cotton, 100% polyester, and/or a blend of any of these fibers. The fabric is typically woven 82 inches wide and laminated with a polyurethane laminate, which can repel liquids and permeation by bed bugs.

The encasement of the invention uses materials that satisfy various testing requirements. The encasement 1 uses a YKK zipper 2 and meets certain ASTM testing requirements as follows:

- ASTM D4034 Seam Slippage Test—ACT standards call for a minimum of 25 pounds in warp and weft. The encasement of the invention exceeds those standards by using a self-imposed minimum of 35 pounds in warp and weft for that test.
- ASTM D2261 Tongue Tear Test—Minimum of 8 pounds.
- ASTM D5034 Tensile Strength/Breaking strength test—Minimum 25 pounds
- FR code of California bulletin 117 is met or exceeded.
- ASTM D5362 Bean Bag Snag test is met or exceeded.
- AATCC 8 Wet/Dry Crocking—The encasement of the invention meets or exceeds a 4.0 for dry and a 3.5 rating for wet crocking.
- ASTM D3512 Random Tumble Pill test—Fabrics on a pretenduvet meet or exceed a rating of 4.0.

AATCC 96-2004 Dimensional Changes in laundering—The encasement of the invention has less than 3% shrinking after 3 launderings.

The invention claimed is:

1. A mattress encasement with improved bed bug protection, the mattress encasement comprising:

an encasement body configured to cover a mattress;

a zipper disposed at an opening in said encasement body and movable between an open condition permitting insertion and removal of the mattress and a closed condition preventing bed bugs from traversing said zipper, said zipper having a zipper head and a zipper pull pivotable on said zipper head;

a clasp at least partly fixed to said encasement body; and a hook-and-loop fastener associated with said zipper pull and said clasp for locking said zipper pull to said clasp with said zipper in said closed condition to prevent movement of said zipper head and opening of said zipper, said hook-and-loop fastener having a material with hooks and a material with loops, said material with hooks being attached to one of said zipper pull or said clasp and said material with loops being attached to the other of said zipper pull or said clasp.

2. The mattress encasement according to claim 1, wherein said clasp has a fixed portion attached to said encasement body and a movable portion hinged to said fixed portion for sandwiching said zipper pull between said fixed and movable portions of said clasp in said closed condition of said zipper.

3. The mattress encasement according to claim 1, wherein said material with hooks forms one piece with one of said zipper pull or said clasp and said material with loops forms one piece with the other of said zipper pull or said clasp.

4. The mattress encasement according to claim 1, wherein said encasement body is formed of 100% Lyocell.

5. The mattress encasement according to claim 1, wherein said encasement body is formed of 100% cotton.

6. The mattress encasement according to claim 1, wherein said encasement body is formed of 100% polyester.

7. The mattress encasement according to claim 1, wherein said encasement body is formed of a blend of at least two fibers selected from the group consisting of Lyocell, cotton and polyester.

8. A mattress encasement comprising:

an encasement body configured for covering a mattress;

a zipper disposed at an opening in said encasement body, said zipper having a zipper head movable between an open position permitting insertion and removal of the mattress and a closed position preventing bed bugs from traversing said zipper, said zipper head having a zipper pull pivotable on said zipper head;

a clasp at least partly fixed to said encasement body; and a hook-and-loop fastener defining at least a portion of said zipper pull and defining at least a portion of said clasp, said portions engaging one another in said closed position of said zipper head for locking said zipper pull to said clasp and preventing movement of said zipper head and opening of said zipper.

9. The mattress encasement according to claim 8, wherein said portion of said clasp is disposed between said encasement body and said zipper pull and engages a side of said zipper pull facing said encasement body in said closed position of said zipper head.

10. The mattress encasement according to claim 8, wherein said portion of said clasp is disposed between said encasement body and said zipper pull and engages a side of said zipper pull facing said encasement body and said portion of said clasp further extends to engage a side of said zipper pull facing away from said encasement body in said closed position of said zipper head.

11. The mattress encasement according to claim 8, wherein said hook-and-loop fastener has a material with hooks and a material with loops, said material with hooks being associated with one of said zipper pull or said clasp and said material with loops being associated with the other of said zipper pull or said clasp.

12. The mattress encasement according to claim 11, wherein said clasp has a fixed portion attached to said encasement body and a movable portion hinged to said fixed portion for sandwiching said zipper pull between said fixed and movable portions of said clasp in said closed condition of said zipper.

13. The mattress encasement according to claim 11, wherein said material with hooks is attached to one of said zipper pull or said clasp and said material with loops is attached to the other of said zipper pull or said clasp.

14. The mattress encasement according to claim 11, wherein said material with hooks forms one piece with one of said zipper pull or said clasp and said material with loops forms one piece with the other of said zipper pull or said clasp.

* * * * *